US010746187B1

(12) United States Patent
Kacines

(10) Patent No.: US 10,746,187 B1
(45) Date of Patent: Aug. 18, 2020

(54) FLYING OBJECT ATTACHED TO A CEILING FAN BLADE

(71) Applicant: Jeffery J. Kacines, Allen, TX (US)

(72) Inventor: Jeffery J. Kacines, Allen, TX (US)

( * ) Notice: Subject to any disclaimer, the term of this patent is extended or adjusted under 35 U.S.C. 154(b) by 15 days.

(21) Appl. No.: 16/219,270

(22) Filed: Dec. 13, 2018

(51) Int. Cl.
*F04D 29/00* (2006.01)
*F04D 25/08* (2006.01)

(52) U.S. Cl.
CPC ..... *F04D 29/005* (2013.01); *F04D 25/088* (2013.01); *F05B 2280/5001* (2013.01)

(58) Field of Classification Search
CPC ... F04D 29/005; F04D 25/088; A63H 33/006; F23V 33/0096
USPC ..... 40/430; 446/236–266; 416/62
See application file for complete search history.

(56) References Cited

U.S. PATENT DOCUMENTS 1,514,602 A * 11/1924 Charland ..... A63H 27/04 472/10
1,614,602 A 11/1924 Charland
2,043,022 A * 6/1936 Twite ..... A47C 7/64 211/30
2,485,870 A * 10/1949 Edson ..... F41J 9/08 244/3.23
4,817,937 A * 4/1989 Ozeki ..... A63H 27/04 446/30
5,020,264 A * 6/1991 Demski ..... A01K 97/06 43/25.2
5,146,702 A * 9/1992 Belokin, Jr. ..... G09F 19/08 40/414
5,591,006 A * 1/1997 Demeo ..... F04D 29/388 416/146 R
5,658,129 A 8/1997 Pearce
6,464,594 B1 10/2002 Canna et al.
D474,267 S * 5/2003 Mosley, Sr. ..... F04D 25/088 D23/366
6,613,287 B1 * 9/2003 McElligott ..... A61L 9/042 239/57
6,836,986 B2 1/2005 Ootsuta et al.
6,971,854 B2 * 12/2005 Krakowski ..... A63H 33/006 416/146 R
7,011,499 B2 * 3/2006 Tomlin ..... F04D 25/088 150/154

(Continued)

OTHER PUBLICATIONS

Ashley, Make It Love It, "Elastic Band Skirt" Aug. 20, 2012. https://makeit-loveit.com/elastic-waist-band-skirt-tutorial (Year: 2012).*

(Continued)

*Primary Examiner* — Michael Lebentritt
*Assistant Examiner* — Topaz L. Elliott
(74) *Attorney, Agent, or Firm* — Roger N. Chauza, PC

(57) ABSTRACT

An arrangement for attaching an object to a fan blade so that the orientation of the object can be adjusted to achieve a desired orientation while the fan blade is rotated by the fan. The object is attached to the bottom end of an invisible filament. The top end of the invisible filament is attached to an enlargement, such as a button. The button is captured between the fan blade and an elastic band that encircles the fan blade. The button can be manually rotated to thereby rotate the invisible filament and the object so that the object is oriented in the desired manner when rotated by the fan. The object can be of the type that flies with a natural orientation, such as a bird, airplane, space ship, etc.

11 Claims, 3 Drawing Sheets

(56) References Cited

U.S. PATENT DOCUMENTS

| | | | | |
|---|---|---|---|---|
| 7,318,701 | B2 * | 1/2008 | Farmer | F04D 25/088 416/224 |
| 9,247,785 | B1 | 2/2016 | Kacines | |
| 2005/0152783 | A1 * | 7/2005 | Tomlin | F04D 25/088 416/62 |
| 2005/0186073 | A1 * | 8/2005 | Krakowski | A63H 33/006 416/62 |
| 2007/0110581 | A1 * | 5/2007 | Farmer | F04D 25/088 416/224 |
| 2008/0248714 | A1 * | 10/2008 | Zacharias | A63H 33/006 446/228 |
| 2010/0261404 | A1 * | 10/2010 | Zacharias | A63H 33/006 446/228 |
| 2010/0267310 | A1 * | 10/2010 | Jeong | A63H 33/006 446/227 |
| 2014/0082893 | A1 * | 3/2014 | Kacines | F16M 11/12 24/132 R |
| 2018/0290716 | A1 * | 10/2018 | Nams | B63B 21/663 |

OTHER PUBLICATIONS

Dave. Halloween—Halloween Bats. Home Depot Community. http://community.homedepot.com/howto/DiscussionDetail/Halloween-Halloween-Bats-9065000000004IE (Year: 2012).*

Nanopeeps "Paper Airplane Ceiling Fan Mobile". Nov 11, 2014. https://www.youtube.com/watch?v=002lkn82byg (Year: 2014).*

Ian McCullough. Ceiling Fan +Paper Airplanes = Fun!. Jul. 14, 2016. https://www.youtube.com/watch?v=Pkcz3zgEldU (Year: 2016).*

Hellracer 1916. Airplanes on a ceiling fan. Apr. 21, 2018. https://www.youtube.com/watch?v=MNR90Ldqehs (Year: 2018).*

Beadalon, www.amazon.com (Year: 2020).*

Soucie, G. "Hook, Line, and Sinker". Holt and Company, 1994. p. 140 (Year: 1994).*

* cited by examiner

FLYING OBJECT ATTACHED TO A CEILING FAN BLADE

TECHNICAL FIELD OF THE INVENTION

The present invention relates in general to ornaments attached to a ceiling fan, and more particularly to methods and apparatus for suspending ornaments from a ceiling fan while maintaining the orientation of the object during ceiling fan operation.

BACKGROUND OF THE INVENTION

Ornaments abound in the lives of many persons for the aesthetic pleasure of the viewer. One area for displaying ornaments involves the use of ceiling and other types of fans where the ornaments are attached to or suspended from the blades of such types of fans. U.S. Pat. Nos. 5,658,129 and Des. 364,223 and a host of other related patents disclose the practice of placing decorative ornaments directly to the underside of the fan blades. Other patents, such as U.S. Pat. Nos. 7,011,499 and 5,516,264, and others disclose the use of fan blade covers, where the underside of the covers are decorated with ornaments and designs.

The ornaments and designs attached to the underside of the fan blades themselves, or to the underside of the fan blade covers are readily observable when the fans are not operating, i.e., when the fan blades are stationary.

Those skilled in the art have found that decorative ornaments can be suspended from the fan blades and observed while the fan is operating. Decorative ornaments suspended from fan blades are disclosed in U.S. Pat. Nos. 6,971,854 and 7,011,499. Such ornaments are known as mobile type of ornaments that are commonly suspended over or near an infant's bed. Indeed, other ornaments can be of the type that are constructed for moving, such as airplanes, rockets, race cars, etc. Thus, the movement of the ornament while the fan blade is rotating simulates the real life situation. The flying type of this type of ornament is disclosed in U.S. Pat. No. 4,817,937.

It can be seen from the foregoing that there is a need for an arrangement in which objects having a natural orientation during flight can be attached to a fan blade so that when the fan rotates the blade, the object maintains its natural orientation.

SUMMARY OF THE INVENTION

In accordance with the principles and concepts of the invention, disclosed is an arrangement for mounting an object to a fan blade so that the orientation of the object can be adjusted such that it remains oriented in the desired position as the fan rotates. A bird, for example, can be attached to the fan blade with the arrangement so that when the fan rotates the bird, the head of the bird remains oriented forwardly, much like a real bird flies in the air.

In accordance with an embodiment of the invention, the object is attached to an enlarged part of a filament line, and the enlargement is captured between the bottom surface of the fan blade and an elastic band that encircles the fan blade. If the object needs rotational adjustment, the enlargement can be manually rotated so that the filament line and the object is also adjusted. Accordingly, as the fan rotates the object, it can be oriented in many different orientations by rotating the enlarged object. The elastic band tightly captures the enlargement and holds it against the bottom surface of the fan blade and prevents it from inadvertently rotating during operation of the fan.

According to a feature of the invention, the filament line comprises an invisible or transparent line so that it appears that the flying object is not connected to the fan.

According to another feature of the invention, the enlargement resists rotational movement due to friction because of its being captured between two materials, the texture of the enlargement, the use of rubberized surfaces, etc. However, the rotation of the enlargement can be achieved manually to rotate it and thus the line to which the object is connected.

A further embodiment comprises an object to which the rotational arrangement is connected, rather than to the fan blade. In this embodiment, the enlargement is captured against rotation to the object, and the filament line is firmly attached to the elastic band encircling the fan blade.

According to another embodiment, a rotational arrangement can be located at the top end of the filament line, and a second rotational arrangement can be located at the bottom end of the filament line. In this embodiment, the rotational orientation of the object can be adjusted at either the top end of the filament line, or at the bottom end, or both.

In accordance with an embodiment of the invention, disclosed is an adjustable rotation arrangement attachable to the blade of a fan of the type having at least two blades rotated by a fan motor for circulating air. The rotation arrangement includes an elastic band attachable around a blade of the fan, where the elastic band fits snugly around the fan blade so that when the fan blade is rotated, the elastic band remains attachable at a desired position on the fan blade. Further included is an enlargement attached to a top end of a flexible tether, and an object attached to a bottom end of the flexible tether so as to be suspended by the fan blade. The object is thus rotatable with the fan blade. The flexible tether has an upper end that extends through the elastic band, and the enlargement is captured between the surface of the fan blade and the elastic band so as to resist rotation about an axis of the object. But, the enlargement can be rotated by the user to thereby rotate the flexible tether and the object to achieve a desired orientation of the object while being rotated by the fan blade.

In accordance with a further embodiment of the invention, disclosed is an adjustable rotation arrangement attachable to a blade of a fan of the type having at least two blades rotated by a fan motor for circulating air. The rotation arrangement includes an object that is suspended from the fan blade and is rotated when the fan blade rotates. The rotation arrangement further includes a flexible tether having a first end and a second end. The rotation arrangement has an enlargement that is captured between two surfaces so that the enlargement resists rotation due to friction between the enlargement and the two surfaces. The rotation arrangement is located at least adjacent one of the fan blade or the object. The object is suspended downwardly by the flexible tether.

According to yet another embodiment of the invention, disclosed is a method of providing an adjustable rotation arrangement attachable to a blade of a fan of the type having at least two blades rotated by a fan motor for circulating air. The method includes providing an object that is suspended from the fan blade and is rotated when the fan blade rotates. Further included in the method is providing a flexible tether having a first end and a second end, providing as a component of the rotation arrangement an enlargement that is captured between two surfaces so that the enlargement resists rotation due to friction between the enlargement and the two surfaces. The rotation arrangement is located at least adjacent one of the fan blade or the object. The method further includes allowing the object to be suspended downwardly by the flexible tether.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
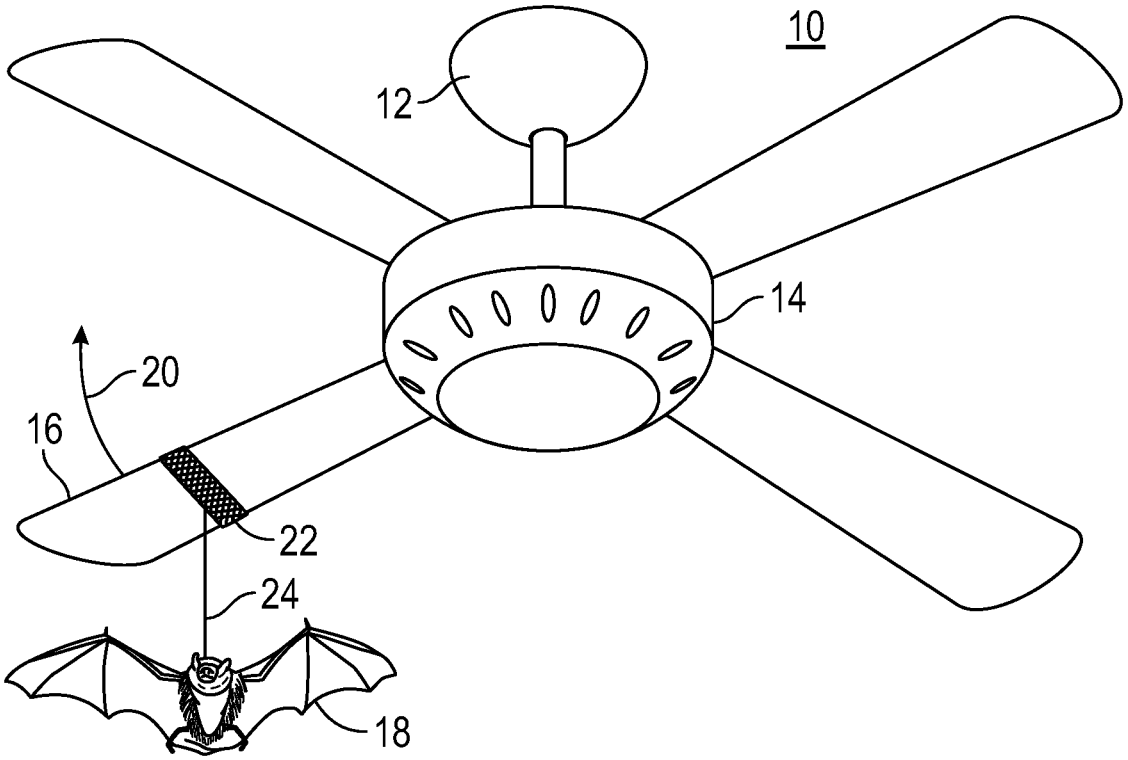
FIG. 1 is an isometric view of a conventional ceiling fan equipped with the flying object according to the invention.

With reference to FIG. 1 of the drawings, there is illustrated a conventional ceiling fan 10 suspended from the ceiling by a base 12. The fan 10 is equipped with a motor 14 which is controlled by a wired or wireless control (not shown). The motor 14 is connected to plural fan blades, one shown as numeral 16. As the rotor of the motor 14 rotates, the fan blades 16 also rotate. Generally, the fan 10 can operate at different speeds, each of which can be controlled by the user of the fan 10. Ceiling fans 10 can be constructed to operate either inside or outside, and can be equipped with fan blades of many different shapes.

In accordance with the principles and concepts of the invention, one or more of the fan blades 16 can have attached thereto an object, such as a flying bat 18 which has a natural orientation during flight. In the example, the fan blades 16 are rotating clockwise in the direction of the arrow 20 when viewed from under the fan 10. Of course, many other objects can be attached to the fan blade 16 which have natural flying orientations, such as airplanes, space ships, flying saucers, etc. In addition, it is not necessary to the operation of the invention that the object 18 has a natural flying orientation, but that the object has a certain orientation that is desired by the user of the fan 10.

In the illustration of FIG. 1, the bat 18 has a natural orientation where the feet are oriented downwardly, the head up and flying forwardly, similar to other birds, although bats are known for flying erratically in many orientations. As another example, the natural orientation of an airplane is that it is upright with the nose pointed forwardly. Cars and other land vehicles, while they do not normally fly, can be suspended from the fan blades 16 with the grille or front bumper of the vehicles pointing forwardly.

The arrangement for suspending an object 18 from a fan blade 16 in a desired orientation includes an elastic band 22 that encircles the blade 16 and fits tightly thereto. An elastic band 22 is preferred as it can fit around many shapes of fan blades 16. According to this embodiment, a line or tether 24 is connected at a top end thereof to the elastic band 22 in a manner to be described below, and is connected at a bottom end thereof to the object 18. The tether 24 is preferably constructed of a material that does not easily twist or rotate around an axial axis (vertical as illustrated) of the tether 24. In a preferred embodiment, the tether is constructed of a transparent fishing line or filament having a diameter of about 0.4 mm. Other line thicknesses can be employed with equal effectiveness. The transparency of the tether 24 allows the object 18 to appear as flying without any connection to other equipment.

Figure 2:
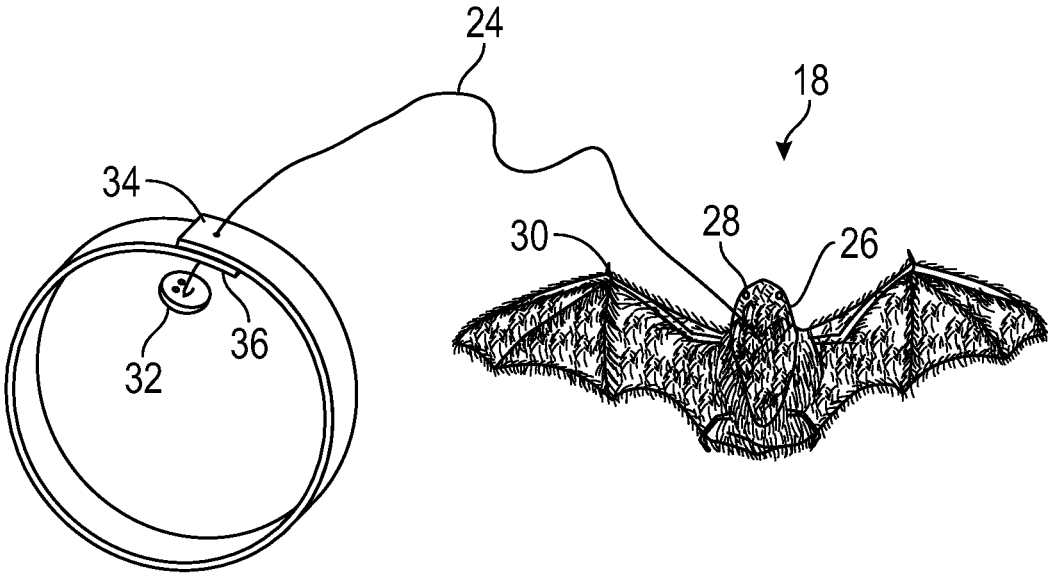
FIG. 2 is a plan view of the components of an embodiment of the invention.

With reference now to FIG. 2, there is illustrated the components of an embodiment of the invention. The flying object which has a natural orientation comprises a bat 18. The bat 18 is constructed with a body 26 covered with hair-like material, much like a live bat. A head with eyes 28 comprise a part of the body 26 formed at the frontal part of the bat 18. Connected to the opposite sides of the body 26 of the bat 18 is a pair of wings, one shown as numeral 30. Again, the wings 30 are constructed to have the appearance of a live bat. As noted above, many other objects can be employed instead of the bat 18.

A transparent, or invisible, fishing filament 24 is connected to the top part of the bat 18 in a position where, when suspended therefrom, the bat 18 is balanced and is generally level with the wings 30 extending horizontally and outwardly. The end of the transparent filament 24 is connected to the top of the bat 18 with a hook (not shown). The hook is fastened to the end of the filament 24, and then the hook is inserted into the Styrofoam body of the bat 18 and bonded with a hot glue. Feathers are also attached to the Styrofoam body using a glue.

The opposite end of the transparent filament 24 is threaded through the elastic band 22 and connected to a conventional button 32 having two or more holes for a thread. The button 32 can be constructed of plastic or other suitable material. The transparent filament 24 is connected to the button 32 using a knot, glue or other suitable means.

The elastic band 22 can be constructed of conventional elastic material, but could be any other material that stretches and can clamp onto a fan blade 16. Conventional elastomeric, elastic and other type of stretchable bands can be utilized. Indeed, the elastic band 22 could be a heavy duty rubber band, or other elastomeric material. The elastic band 22 includes a length suitable for stretching around conventional fan blades. When the fan blade to be used is of an unusual design, such as a leaf, the elastic band can be constructed with a length to accommodate the larger type of fan blades. Otherwise, the elastic band 22 can be constructed with suitable lengths for stretching around standard-size fan blades 16.

The elastic band 22 can be constructed as an endless item, but can be constructed with ends 34 and 36, as illustrated. The ends 34 and 36 are sewn together in an overlapping manner so that the band 22 has a double thickness at the area where the transparent tether 24 passes therethrough. This feature allows somewhat more pressure to be placed on the button 32, against the bottom surface of the fan blade 16.

Figure 3:
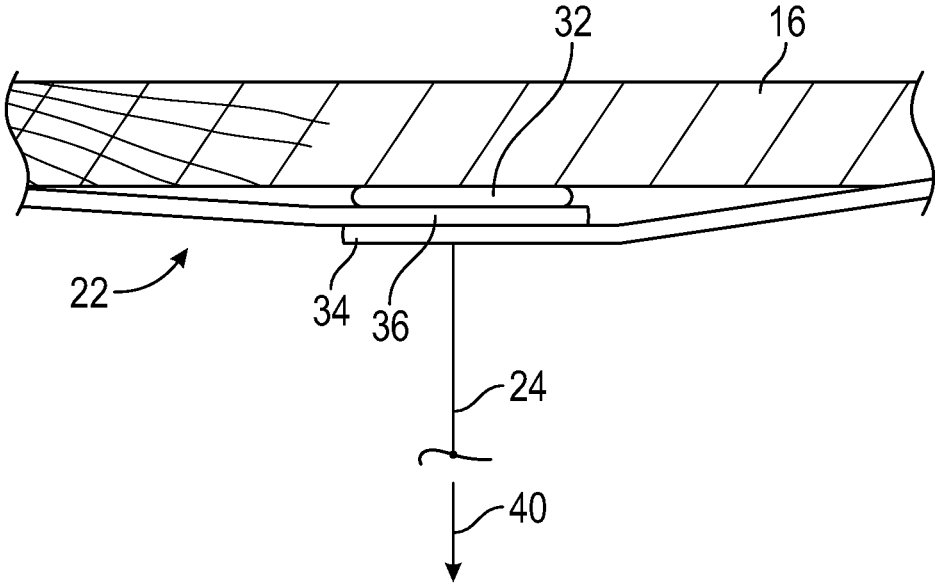
FIG. 3 is a partial cross-sectional view of the enlarged end of the tether captured between the fan blade and the elastic band.

FIG. 3 illustrates in enlarged form the manner in which the button 32 is captured between the bottoms surface of the fan blade 16 and the elastic band 22 which is stretched around the fan blade 16. As can be seen, when the button 32 is situated between the bottom surface of the fan blade 16 and the elastic band 22, there is a component of the force of the elastic band 22 that is orthogonal to the button 32 and forces the button 32 against the fan blade surface. This orthogonal force tends to help inadvertent rotation of the button 32 during operation of the fan 10. Moreover, in order for the button 32 to rotate, the friction between the top surface of the button 32 and the bottom surface of the fan blade 16, together with the friction between the bottom surface of the button 32 and the elastic band 22, must be overcome. These frictional forces can, however, be overcome by a user accessing opposite sides of the button 32 with user's index finger and thumb and twisting the button 32 to a new rotational position. When the button 32 is released by the user, the frictional forces then predominate and prevent any further inadvertent rotation during operation of the fan 10. As can be appreciated, the axial downward force of the invisible filament 24 is also orthogonal to the face of the button 32. The downward force exerted by the invisible filament 24 is illustrated as arrow 40 in FIG. 3.

In order to further prevent inadvertent rotation of the button 32, the button 32 itself can be constructed with a material that exhibits a high friction, such as a soft elastomeric material, or can be constructed with a covering or outer layer of a high friction material, such as a rubberized coating. The enlargement 32 fastened to the top end of the invisible filament 24 could also include sharp or rough edges or other arrangements that resist rotation of the enlargement 32 with respect to either the bottom surface of the fan blade 16 or the top surface of the elastic band 22, or both.

In practice, the invisible filament 24 is fastened to the button 32 or other type of enlargement so that the filament 24 cannot rotate within the button 32 or enlargement. To that end, top end of the invisible filament 24 is threaded through more than one holes of the button 32 and then appropriately tied in a knot (not shown). This contrasts with threading the top end of the invisible filament 24 through just one button hole and tying a knot so that it cannot be pulled back through the button hole. In this latter practice, the top end of the invisible filament could turn within the button hole together with the knot.

Figure 4:
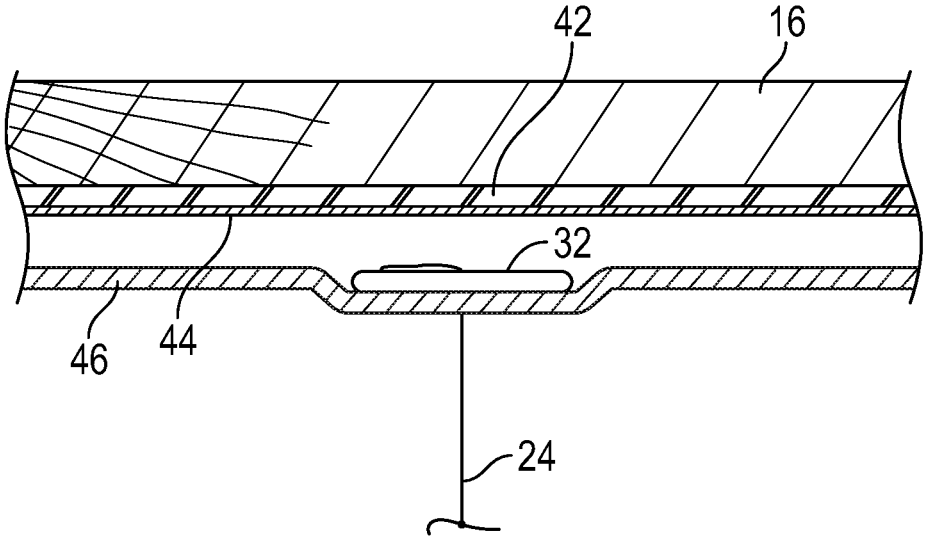
FIG. 4 is a partial cross section of the fan blade with the elastic band stretched therearound, and with the button attached to the elastic band using a hook and loop fastener strip.

FIG. 4 illustrates another embodiment of the arrangement for attaching an object to a fan blade 16. Here, the elastic band 42 has attached thereto a strip of one of a hook and loop fastener 44, such as the hook material. The strip 44 is attached to the bottom surface of the elastic band 42, under the fan blade 16. The hook strip of material 44 can be attached to the bottom surface of the elastic band 42 using an adhesive or other bonding technique.

In FIG. 4, the button 32 is shown removed from the bottom of the fan blade 16 for purposes of clarity. The invisible filament 24 is attached to the button 32 via the button holes (not shown) in the manner described above. The invisible filament 24 is then threaded through a strip 46 of the other of the hook and loop material, such as the loop material. The strip 46 of loop material is then attached to the hook material 44 by pressing the loose strip 46 to the upper strip 44. If the button 32 is not accessible because of the width of the lower loose strip 46, then one end of the lower strip 46 can be removed from the upper strip 44 to expose the button 32 to rotate it and adjust the rotational orientation of the object 18 attached to the bottom end of the invisible filament 24.

Figure 5:
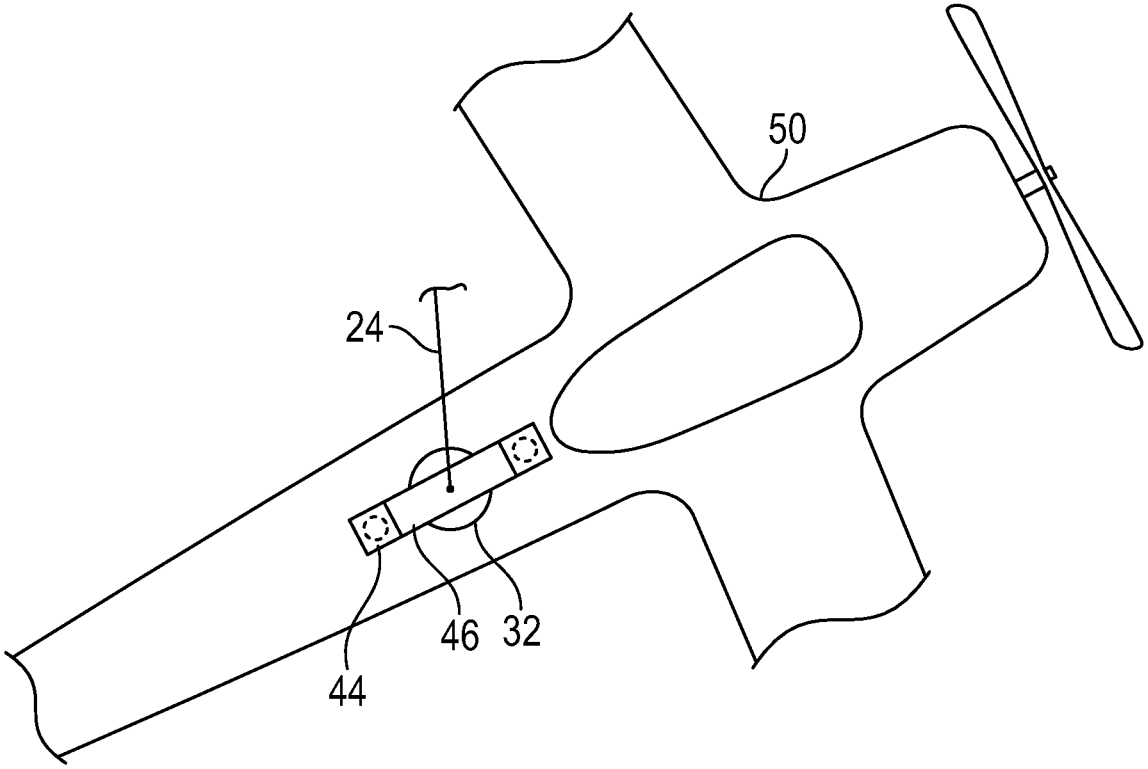
FIG. 5 is yet another embodiment in which the rotating arrangement is connected to the object instead of the fan blade.

FIG. 5 illustrates yet another arrangement in which an object, such as an airplane 50, can be mounted to a fan 10 and obtain a desired orientation when rotated by the fan 10. Here, the rotational arrangement is connected to the object 50 instead of the fan blade 16. In other words, the enlargement 32 is attached to the bottom end of the filament line 24, rather than the top end. The top of the filament line 24 can nevertheless be connected to an elastic band 22 that encircles the fan blade 16. Preferably, the top end of the filament line 24 is attached to the elastic band 22 so that the line 24 cannot rotate within the elastic band 22. The top end of the filament line 24 can thus be glued to the elastic band 22. In the arrangement of FIG. 5, a hook material 44 can be adhesively connected to the top of the fuselage of the airplane 50, at a location to achieve balance so that the airplane 50 is rotated in level flight. The loop material 46 can be used to capture the enlargement 32 to the hook material 44 and prevent inadvertent rotation during operation of the fan 10. The capturing of the enlargement 32 is much like that described in connection with the arrangement of FIG. 4. Of course, the hook material 44 and the loop material 46 can be reversed as to location. Moreover, the hook material 44 can be much longer than the loop material 46 so that the attachment therebetween can be chosen to achieve a balance of the airplane as suspended from the invisible filament 24.

In this embodiment, the enlargement, or the button 32 in the illustration, is not entirely captured between the hook and loop strips 44 and 46. Rather, a portion of the button 32 on each side of the loop material 46 is exposed so that the user can grasp the opposite sides of the button 32 and manually rotate it to achieve a different orientation of the airplane 50 with respect to the invisible filament 24.

Those skilled in the art may prefer to provide a rotational arrangement at both the top end of the filament and at the bottom end of the filament so that the orientation of the object can be adjusted at either end of the invisible filament. The same or different types of rotational arrangements can be employed at both ends of the filament line.

While the preferred and other embodiments of the invention have been disclosed with reference to specific rotational arrangement components, and associated methods of fabrication thereof, it is to be understood that many changes in detail may be made as a matter of engineering choices without departing from the spirit and scope of the invention, as defined by the appended claims.

What is claimed is:

1. An adjustable rotation arrangement attachable to a blade of a fan of the type having at least two blades rotated by a fan motor for circulating air, said rotation arrangement comprising:

an elastic band material attachable around a blade of the fan, said elastic band material fitting snugly around the fan blade so that when the fan blade is rotated, the elastic band material remains attachable at a desired position on the fan blade;

a flexible tether having an enlargement attached to an upper end thereof so that said flexible tether adjacent said enlargement does not rotate except when said enlargement is rotated;

an object attached to a bottom end of said flexible tether so that said object is suspended by the fan blade, and said object is rotatable with the fan blade;

the upper end of said flexible tether having an upper end that extends through the material of said elastic band; and said enlargement is captured between a bottom surface of the fan blade and said elastic band, and an elasticity of said elastic band material exerts a frictional force on said enlargement so that said enlargement resists inadvertent rotation, but said enlargement can be rotated by the user to thereby rotate the upper end of said flexible tether that is adjacent said enlargement.

2. The rotation arrangement of claim 1, wherein said elastic band material includes two ends that overlap, and the top end of said flexible tether extends through both said ends of said elastic band material.

3. The rotation arrangement of claim 1, wherein said object is of the type which has a natural orientation of flight when moving through the air.

4. The rotation arrangement of claim 3, wherein said object is one of a group including an airplane, a bat, a bird, a rocket or a spaceship.

5. The rotation arrangement of claim 1, wherein said enlargement is friction fit between the bottom surface of the fan blade and said elastic band material.

6. The rotation arrangement of claim 5, wherein an orientation of said object can be changed by manually rotating the enlargement to a different friction fit between the fan blade bottom surface and said elastic band material.

7. The rotation arrangement of claim 1, wherein said enlargement comprises a button.

8. The rotation arrangement of claim 1, wherein said enlargement comprises a knot tied at the upper end of said flexible tether.

9. The rotation arrangement of claim 1, wherein said flexible tether is suspended from said enlargement and is orthogonal thereto.

10. The rotation arrangement of claim 1, wherein said flexible tether is threaded through said elastic band material without forming a slit opening in said elastic band material.

11. The rotation arrangement of claim 1, wherein said elastic band material has sufficient elasticity to exert an orthogonal force on said enlargement to force said enlargement against the bottom surface of said fan blade, and the orthogonal force provides a friction between the bottom surface of said fan blade and a top of said enlargement, and said orthogonal force provides a friction between a bottom of said enlargement and said elastic band material.

* * * * *